United States Patent [19]

Bartels

[11] 4,114,405

[45] Sep. 19, 1978

[54] CONTROL UNIT FOR A HAND KNITTER

[75] Inventor: Manfred Bartels, Cologne, Fed. Rep. of Germany

[73] Assignee: Empisal Knitmaster Luxembourg S.A., Luxembourg, Luxembourg

[21] Appl. No.: 839,931

[22] Filed: Oct. 6, 1977

[51] Int. Cl.[2] ..... D04B 7/00; D04B 15/66

[52] U.S. Cl. ..... 66/75.2; 66/76

[58] Field of Search ..... 66/154 A, 75.2, 50 R, 66/70, 73, 76

[56] References Cited

U.S. PATENT DOCUMENTS

| | | | |
|---|---|---|---|
| 3,817,059 | 6/1974 | Krause | 66/75.2 X |
| 3,844,139 | 10/1974 | De Cerjat et al. | 66/50 R |
| 3,983,370 | 9/1976 | Caspi et al. | 66/50 R X |
| 4,015,445 | 4/1977 | Kahan et al. | 66/75.2 |

*Primary Examiner*—Ronald Feldbaum
*Attorney, Agent, or Firm*—Spensley, Horn & Lubitz

[57] ABSTRACT

In this control unit for a hand knitter, a data source such as a magnetic tape recorder provides both the row-by-row knitting pattern data and shaping information related to the outline contour of the article to be knitted. The shaping data is supplied as row numbers and stitch data specifying the number of stitches to be added or cast off in each knitted row identified by the row numbers. The control unit compares the supplied row numbers to the number of the row next to be knitted. If stitch changes are required, the requisite stitch data is visually displayed, and optionally the knitter carriage is momentarily blocked and an audible signal is sounded.

23 Claims, 8 Drawing Figures

CONTROL UNIT FOR A HAND KNITTER

The invention relates to a control unit for a hand knitter which comprises a plurality of needles in a needle bed on which a carriage which sets the positions of the needles individually in accordance with the proposed knitting pattern and which realises the knitting operation, is displaceable transversely to the needles.

It has been known to store in knitters the pattern (e.g. color pattern) of the knitting to be prepared, for the individual knitting rows in a magnetic tape storage device (German Auslegeschrift No. 1 635 974). Said knitting pattern data are supplied to row stores which always accept the knitting data for one row. During the knitting operation, a cam or carriage is guided along the needle bed, and, at the same time, the needles generate at a sensor of the carriage clock pulses which are used to control the selection of the knitting pattern data from the row store concerned. To this effect, one row store is provided for the advance and another for the return of the carriage. The known control unit only refers to the transmission of the knitting pattern data to the magnet selecting the needles. A control or indication of the limiting data for the knitting to be prepared does not exist.

Up to the present the person knitting with the hand knitter has to predetermine the limiting data (right end and left end) for each row to be knitted, and during the knitting operation, care must be taken that changes in the row length required by the shape of the object to be knitted are performed in time. This requires a permanent concentration, because the knitting person must not only take care that before knitting a row, having a changed mesh number as compared to the preceding row, the carriage must be stopped to carry out the manipulations necessary for the change of meshes, but at the same time, the number of stitches to be added or left out at the right or left side, must be exactly observed.

It is the object of the instant invention to provide a hand knitter control unit in which the shaping data for the knitting to be prepared are stored so that the manipulation of the machine for the knitting person is substantially facilitated.

To solve this problem, it is provided in the invention that a data source for the shaping of the knitting to be prepared contains the numbers and limiting data of rows of the knitting, that the data source supplies the limiting data to a store for stitch data and the number for the corresponding row to a store for row data and that one row store or row stores are provided containing the number of a row to be knitted and causing the supply of the limiting data to an indicating device if the contents correspond to a number contained in the store for row data.

The control unit of the invention is capable of storing the total shape or the shape pattern of an article to be knitted and of supplying the data of the corresponding row directly prior to the knitting of said row. At the same time, the limiting data of the row are supplied concomitantly so that the knitting person only has to perform mechanically the operations predetermined by the indicating unit. As a result, thinking during knitting is no longer necessary to a far extent and possible mistakes are strongly reduced.

In one advantageous embodiment of the invention, the data source contains only the numbers and limiting data of the rows in which changes against the preceding rows come to pass. Upon reaching the row concerned, only the changes are shown in the stitch indicators. Moreover, an accoustic signal may inform the knitting person that stitch changes must be made manually now at the right and/or left side. Thereafter, the knitting operation is continued.

If the control unit is so designed that the store unit for the stitch numbers and the store for the row data contain at one moment only the data of one sole row, the data source may contain, in addition to the shaping data, the knitting pattern data for each row. In such a case, a selection circuit must be provided which separates the knitting pattern data from the shaping data and supplies the knitting pattern data to one of two row stores. By this means, the knitting data may be supplied from the data source in addition to the shaping data. The selection between knitting pattern data and shaping data is conveniently realised by a counter which subject to a pulse number provided for the transmission of the knitting pattern data causes the subsequent pulses to be changed over to the row counter and to the store for mesh data. This type of selection is suitable where the knitting pattern data and the shaping data are supplied serially from the data source.

In another method of operation of the control unit of the invention the stores for stitch data and for row data contain shaping data of several rows supplied from the data source prior to knitting. The total shape or shape pattern of the article to be knitted is stored in the store. The store for row data and the store for stitch data may be connected with a computer which is connected to a numerical input device for index numbers for stitches and rows.

The data source may be a magnetic tape storage device, e.g. a cartridge recorder, or another tape recorder.

The magnetic tapes carrying the knitting pattern data and the shaping data can be purchased from the producer in the form in which they are to be used. However, the user of the machine is also able to transfer a knitting pattern from an optically readable photographic original to the magnetic tape. She can thus design her own patterns and transfer these to the magnetic tape. For this purpose and in accordance with a further advantageous feature of the invention, a finger-key having two different operative positions is connected to a store which, each time the finger-key is depressed, is indexed one place forward, and in which, each time the finger-key is heavily depressed, information in the form of a bits is additionally fed into the particular place ready to receive. In this way, the pattern information for a row is first stored in the store before it is transferred to the magnetic tape. The person using the machine is therefore not obliged to keep to a certain rhythm during the transfer, in bit form, of the individual stitches. The contents of the store are transferred to the magnetic tape only after all the stitch data for a row have been stored. In this connection, an impulse inlet of the store is expediently connectible to an impulse source which releases a given number of impulses and then switches off the magnetic tape recorder. During recording, the control must be carried out in such a way that after recording the information for one row and before recording the information for the next row, a sufficiently large block gap is formed. It is however possible for the person using the machine to dictate text for example on the magnetic tape at a position following the knitting pattern data. A microphone is provided for this purpose and this can preferably also be used as a loudspeaker and is connected to the magnetic tape recorder. Details regarding the shaping of the knitted article, i.e. the number of stitches to be removed or added at the right or left, or other directions can be dictated on to the magnetic tape.

A form of construction of the equipment in accordance with the invention will now be described in greater detail by reference to the attached drawings, wherein.

Figure 1:
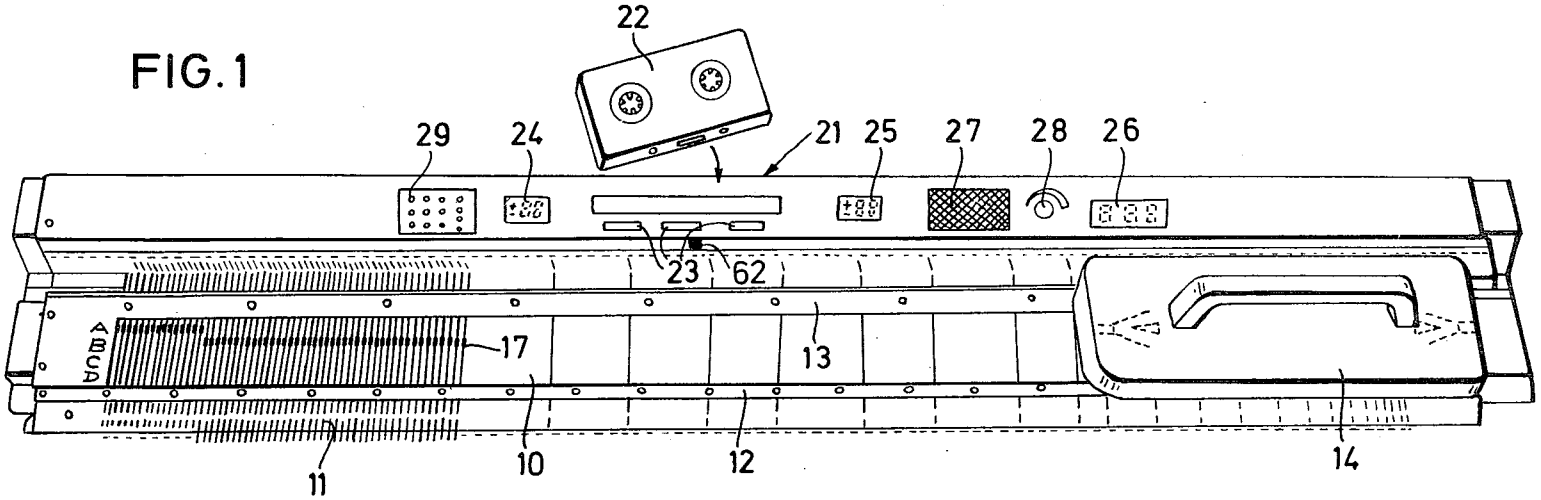
FIG. 1 shows diagrammatically the outer construction of a hand knitter in accordance with the invention.
Figure 3:
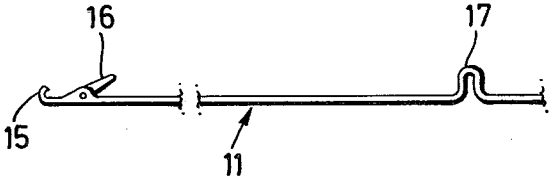
FIG. 3 illustrates the construction of a needle used in the hand knitter.

The hand knitter illustrated in FIG. 1 has a needle bed 10 with a large number of parallel knitting needles 11 which are individually displaceable transversely of the needle bed 10. A carriage 14 is displaceable transversely to the needles over the entire needle bed 10, on two rails 12 and 13. The carriage is moved by hand. At their outer ends the needles, one of which is shown on a larger scale in FIG. 3, are bent upwards and formed as hooks 15 in which the threads can be fitted. Each needle has a pivoted tongue 16 which, in one of its end positions, closes the hook 15.

In that zone of the needle bed 10 that is traversed by the carriage 14, the needles 11 have upwardly directed feet 17 which serve to displace and position the needles. Four different needle positions, A, B, C and D, are marked at the outer end of the needle bed 10. Those needles whose feet 17 are in the A position, are not engaged at all by the cam 14 as it moves past them. They do not therefore participate in the knitting operation. Those needles whose feet are in the B position are actuated by a cam track, provided on the lower face of the carriage 14, so that they execute a certain movement transversely of the needle bed, and this results in a stitch being formed in the known manner. They are then moved back into the B position by the cam 14, so that during the next return run of the cam they are engaged again. The C and D positions are not of importance to an understanding of the basic mode of operation of the machine.

Figure 2:
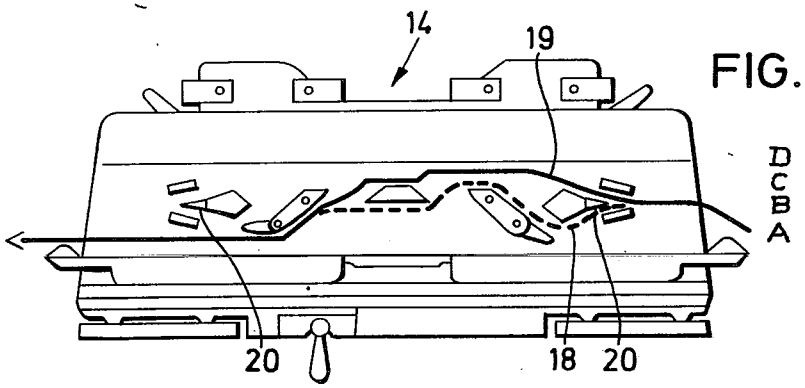
FIG. 2 shows diagrammatically an underneath view of the carriage.

For the purpose of knitting a pattern, two threads of different colour are threaded into the carriage. Those needles that are to pick up the red thread, for example, must move in a time-cycle that is different from that of the needles that are to pick up the blue thread. The needles are selected by the carriage 14, and are move either along the cam track 18 or along the cam track 19 (FIG. 2). These two cam tracks join each other again so that all of the needles that have entered the cam path at the B position also leave it again at that position.

FIG. 2 illustrates the paths of the feet 17 of the needles only for when the carriage is moved in one direction (to the right). When the direction of movement of the carriage is reversed, the same cam tracks, which run from right to left in FIG. 2, run from left to right. The lower face of the carriage is of symmetrical form.

Points 20 are used for selecting the needles. These are electro-magnetically controlled and move the feet 17 of the needles either backwards or forwards so that they are guided on to the cam track 18 or the cam track 19. The points 20 are actuated in dependence upon the magnetically recorded knitting pattern, and the method of control will be described below.

Referring to FIG. 1, the knitter is provided with a cassette-type magnetic tape recorder 21 into which can be fitted a standard tape cassette 22 containing the knitting programme. Suitable keys 23 are provided for causing the magnetic tape recorder 21 to run to the right and to the left, and for stopping it. Also provided on the knitter is a two-place number-indicating device 24 for left-hand stitches and a two-place number-indicating device 25 for right-hand stitches. The indicating devices 24 and 25 each also contain a plus and minus sign relating to the stitches, i.e. information as to whether the indicated number of stitches has to be added or removed. Also provided is a three-place row counter 26 which indicates the number of the particular row. A loudspeaker 27, which can also be used as a microphone, serves for playing-back dictated information, recorded on the magnetic tape, or for recording this information. The loudspeaker 27 also performs a further important function in recording knitting pattern data on the magnetic tape. This will be explained at greater length below. The volume of the loudspeaker 27 can be adjusted by means of a regulating knob 28.

Finally, an input keyboard 29 for indexing the stitches and indexing the rows is provided on the knitter.

The mode of operation of the magnetic tape control means and the method of passing data to the row stores and the various indicating devices will now be described by reference to FIGS. 4 and 5. It will be assumed that the knitting pattern information for a row is recorded on the magnetic tape in the manner illustrated in FIG. 5. The illustrated block contains, first, information 30 in bit form and consisting of an identification and the number of the row concerned. The identification is a certain bit sequence whereby the beginning of the block can be recognized. The information 30 comprises twelve bits. Following this is information 31 which represents the pattern information for the row in question. Since hand knitters usually have a knitting width of 200 stitches, the information 31 consists of 200 bits. The pattern information indicates, for each stitch in a row, whether it should be knitted in, for example, red or blue wool. Following the pattern information a text or music can be recorded. The person using the knitting machine may record operating instructions for example. After the information 32 there follows a block gap 33. The block gap has a certain minimum length, and the reason for this will be explained later; the next block follows the block gap.

Figure 4:
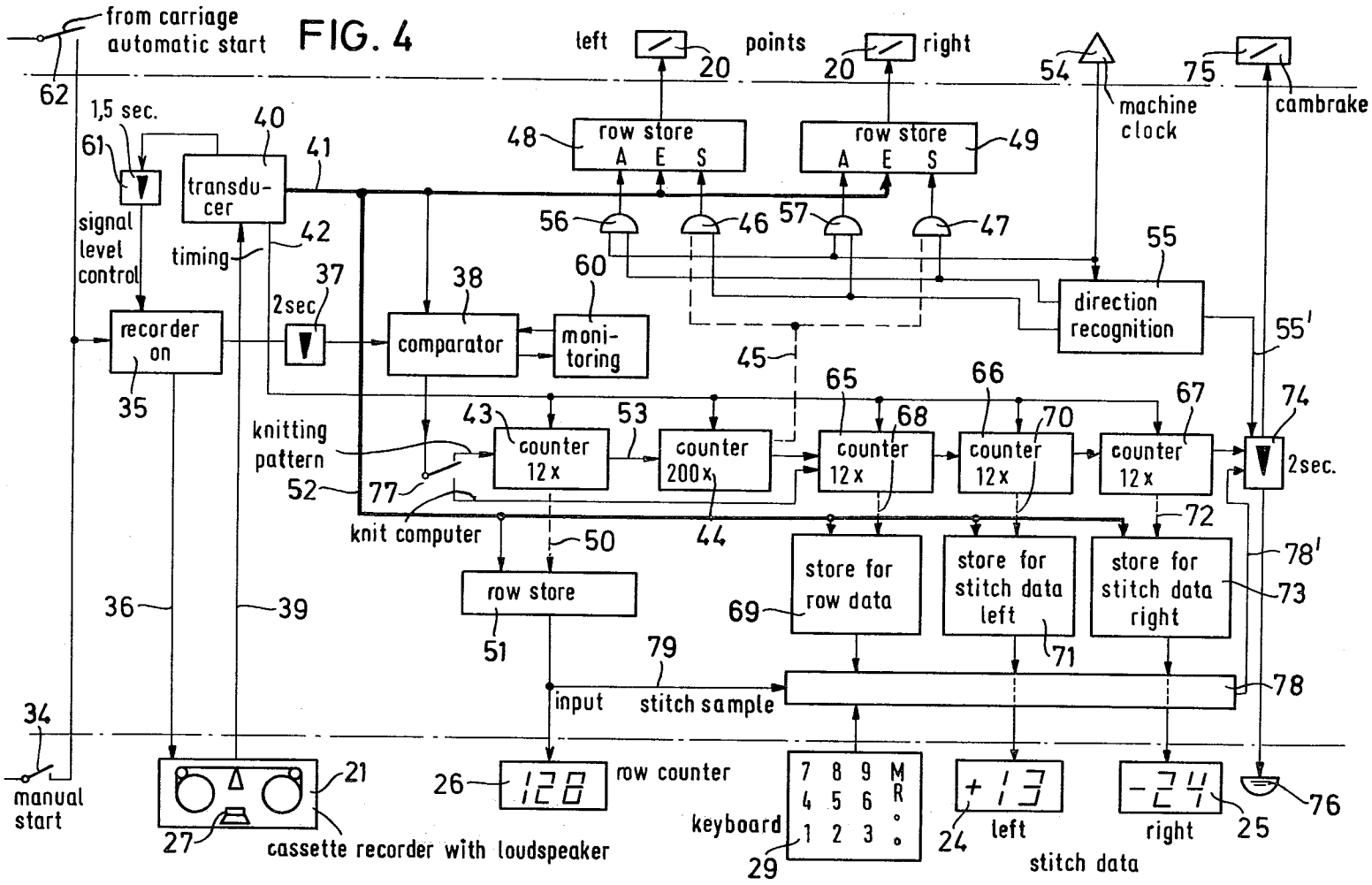
FIG. 4 is a block circuit diagram of the electronic part of the hand knitter.
Figure 5:
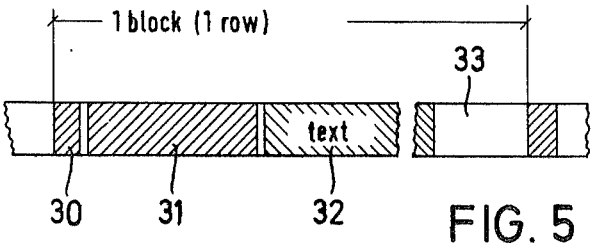
FIG. 5 shows the form of the knitting pattern information for one row, recorded on the magnetic tape.

After a tape cassette having the content illustrated in FIG. 5 has been fitted, the starting switch 34, shown in FIG. 4, is closed by hand. This causes the switch-on control means 35 to be actuated and the magnetic tape recorder 21 to be switched on by way of a conductor 36. At the same time a time-lag element 37, having a delay time of 2 secs. is switched on, and this element starts off a comparator 38 after the delay time has elapsed. The output signal conductor 39 of the magnetic tape recorder 21 is connected to the input of a transducer 40, which at one output 41 provides the recorded information in bit form, and, at a second output 42, provides the timing of the information in bit form. In order to enable the timing information to be derived from the magnetic tape even when several consecutive impulses of like form occur, the recording is carried out by the known phase-shift method, whereby the timing information can always be derived from the total signal.

The information at the output 41 is passed to the comparator 38 in which the identification contained in the bit sequence 30 is stored, so that the comparator 38 can determine the commencement of the pattern information 31.

The timing output of the transducer 40 is connected to the input of a first counter 43 which counts up to twelve and then effects a transfer to a second counter 44 so that the second counter is connected in and counts up to two hundred. While the second counter 44 is counting, its output 45 is activated so that it prepares the writing gates 46 and 47 which lead to the inputs S of the row stores 48 and 49 respectively.

In the here-described procedure for producing a knitting pattern, the comparator 38, as soon as it has responded, connects in the first counter 43 which counts the first twelve timing impulses from the output 42 and, during this time, opens the row counter 51 by way of the output 52, so that, by way of the information conductor 52, the three-place number of the particular row is fed into the row store 51. This row number is optically indicated on the row counter 26.

After the first counter 43 has reached its end position after having counter twelve timing impulses, it passes a transfer signal through a conductor 53 to the second counter 44 which is thereby connected in and counts the next two hundred timing impulses.

Provided on the carriage 14 is an impulse generator 54, which consists of at least two optical, mechanical or other sensors which generate an impulse on passing each needle during movement of the cam. These impulses are passed to the direction-recognizing circuit 55 which produces a signal at the output L when the cam is moved to the left, and a signal at the conductor R when the cam is moved to the right. To enable direction to be recognized, the two sensors in the impulse generator 54 are of differing phase from each other in respect of the distance between needles, so that the direction of movement of the cam can be recognized from the time sequence in which the impulses are generated at the two sensors.

The conductor L of the direction-recognizing circuit 55 is connected to the second input of the AND gate 47 which is associated with the right-hand row store 49, whereas the output R is connected to the second input of the gate 46 which is associated with the left-hand row store 48. The control signal at the conductor 45 that continues for the period of two hundred bits thus passes through the gate 47 during leftward travel of the cam, so that the input S of the row store 49 is activated, and during rightward travel of the cam said control signal passes through the gate 48 so that the input S of the row store 48 is activated.

The signals through the information conductor 52 are always present at the inputs E of the two row stores 48 and 49, but the information signals are stored only in that row store whose input S is energized. This means that when the cam travels to the left, the right-hand row store 49, and when the cam travels to the right, the left-hand row store 48 store the pattern information for the next row.

The signal-release inputs A of the two row stores are connected to the impulse generator 54 through AND gates 56 and 57 respectively, so that the delivery of signals to the points 20 takes place at the same rate that is set up when the needles are passed by one of the sensors fitted on the cam. The second input of the gate 56 is connected to the L-output of the direction-recognizing circuit 55, and the second input of the gate 57 is connected to the R-output of said circuit 55. This arrangement results in the switching of the row counter 48 to "release" when the row store 49 is switched to "store", and vice versa. The row store that is switched to "release" releases the 200 bits stored therein at the machine rate set up by the impulse generator 54. The input of data into the other row store on the other hand takes place in dependence upon the running speed of the magnetic tape.

The described method of controlling the points 20 by the two row stores 48 and 49, in dependence upon the machine rate, enables each of the points 20 always to receive the impulse provided for a certain needle when the foot 17 of this needle is in a position in which it is acted upon by the electro-magnets provided on the points. Selection by mechanically displacing the feet of the needles, such as is carried out in the known hand knitters, is therefore not necessary. It is however important that the impulse generator 54, which determines the moment at which the points 20 in question are energized, should be so set that the impulse generator actuates the points 20 at exactly the correct time. The impulse generator 54 may, for example, be triggered directly by the needles as it passes them. Another possible method is to provide a division scale on the needle bed, along which scale the impulse generator 54 runs.

Connected to the comparator 38 is the second monitoring circuit 60. This is capable of differentiating between information 31 in the form of bits and audio signals 32. The monitoring circuit 60 ensures that the comparator 38 keeps the counters 43 and 44 connected in at most only as long as the information in bit form is recognized. Thereafter the counters are not brought into operation again.

The first monitoring circuit 61 is also connected to the output of the transducer 40. The circuit in this case is a signal-level detector which sends a signal to the switching-on means 35 when the level of the signal emanating from the magnetic tape drops below a predetermined value during a period of, for example, 1.5 sec. The magnetic tape recorder 21 is then switched off through the conductor 36. Such fall below the fixed signal level occurs regularly at the end of the block in the gap 33 (FIG. 5). The gap must therefore be at least as great as the period set at the signal-level detector 61 plus the run-down time of the tape recorder plus the start-up time set at the timelag circuit 37. Only a gap of such length ensures that no information is lost between two blocks (rows) between which the tape recorder is continuously stopped.

After a row has been knitted in this way and the information for the next row has been received from the magnetic tape by the corresponding row store, the tape recorder is started up again by the starting switch 62. This switch 62 is located for example on the frame of the knitter approximately midway along the path travelled by the cam by which it is actuated. When the cam is moved, the information from one of the row stores is passed to the associated points so that the knitting needles are selected correspondingly. When the cam reaches the switch 62, the magnetic tape recorder 21 starts up, and at the earliest 2 sec. thereafter, data is fed into the other row store. The data is fed into this store at the rate set up by the tape recorder, i.e. very rapidly compared with the machine rate 54.

In addition to containing the straightforward knitting pattern data and information in spoken form, the magnetic tape may also contain data for shaping the product to be knitted. When a knitted piece is not to extend over the entire width of two hundred needles, those needles that are not to participate in the production of the knitted piece are brought into the A position (FIG. 1). Only those knitting needles that will be involved in the production of the knitted piece are brought manually into the B position by the person using the knitter.

If the number of stitches is to be reduced during the production of the knitted piece, additional needles at the edge must be brought into the A position. At the same time the stitches must be cast off from these needles and transferred to other needles. These operations have to be carried out by hand by the person using the knitter. To enable the user to know the row from or to which stitches have to be cast off or added, the approporiate data can be provided on the magnetic tape following the pattern information 31 (FIG. 5). For example, a field of 12 bits can be provided in which is stored that number of the row in which the change has to be made. A further field of 12 bits contains the change in stitches to be carried out on the left, and yet another field of 12 bits contains the change in stitches to be made on the right. For processing these data and as shown in FIG. 4, the second counter 44 is followed by a third 12-bit counter 65, a fourth 12-bit counter 66, and a fifth 12-bit counyter 67. The counting impulses are supplied to each of these counters 65 to 67 by the conductor 42. However, each counter only begins to count when it has received the transfer impulse from the preceding counter.

As long as the third counter 65 is counting, it opens, by way of its output 68, a store for the row information, which store is connected to the information conductor 52. As long as the fourth counter 66 is counting, it opens, by way of its output conductor 70, a store 71 for information regarding stitches at the left, which store receives, from the information conductor 52, the appropriate number of stitch changes together with a plus or minus sign. As long as the fifth counter 67 is counting, it opens, by way of its output conductor 72, a store 73 for stitch information at the right, which store is likewise connected to the information conductor 52. In this way, each of the stores 69, 71 and 73 receives from the magnetic tape those data it is intended to receive.

In this mode of operation, the contents of the stores 71 and 73 are displayed on the indicating devices 24 and 25 for the stitch details. FIG. 4 shows for example that the user of the knitter must add thirteen stitches at the left side and cast off twenty-four stitches at the right side. As soon as this has been done, knitting can be continued by reciprocating the cam.

Since stitch changes do not have to be carried out in each row, the knitter is provided with means for reminding the user when stitch changes have to be made in the row being knitted. For this purpose the fifth counter 65 continues to transfer information to a delay element 74 which is connected in for 2 sec. if, the direction-recognizing circuit 55 subsequently indicates, by way of a conductor 55, a change in the direction of movement of the cam. During this period of 2 seconds, the delay element 74 actuates an electro-magnetic brake provided on the cam 14 so that the cam is blocked for a brief period. At the same time a buzzer 76 sounds. The knitting cycle is briefly interrrupted by the brake 75 so that the user of the knitter does not inadvertently continue to knit before the necessary changes have been made.

So far, the "knitting pattern" method of operation has been described by reference to two variants, in one of which only the knitting pattern information is provided on the tape cassette, while in the other, shaping information is provided in addition to the knitting pattern information. A second mode of operation i.e. the "knit computer" procedure will now be described. In this procedure, use is made of a tape cassette in which only the shaping data are recorded. These are stored in the circuit. Then a cassette, which contains only the knitting pattern information is inserted. The switch 77, controlling the type of operation, is then moved again to the "knitting pattern" position.

In the "knit computer" mode of operation, data, as in Table I for example, are recorded on the magnetic tape.

TABLE I

| | Stitches | |
|---|---|---|
| Row | Left | Right |
| 10 | +1 | — |
| 5 | +1 | +1 |
| 8 | −1 | +5 |
| 2 | +1 | +1 |

This means that a stitch must be added on the left to the tenth row. After five further rows a further stitch has to be added on the left as well as on the right, and so on. Thus only each of the subsequent further rows, in which changes in the number of stitches occur, is noted. These data are fed into the circuit by way of the transducer 40. The switch 77 for selecting the type of operation is set to "knit computer", so that neither the first counter 43 nor the second counter 14 is triggered. Instead, the first twelve impulses are passed to the third counter 65, the second twelve impulses to the fourth counter 66, counter 66, and the third twelve impulses to the fifth counter 67. This means that the information regardng rows is continuously fed into the store 69, the information regarding stitches on the left, into the store 71, and the infomation regarding stitches on the right, into the store 73. In this case the stores are so rated that each of them is able to store a series of values as in Table I. The outputs of the stores 69, 71 and 73, as well as the output of the row store 51 are connected to a compouter 78 which controls the indicating devices 24 and 25 and to which, furthermore, index numbers can be fed through the feed keyboard 29.

Figure 6:
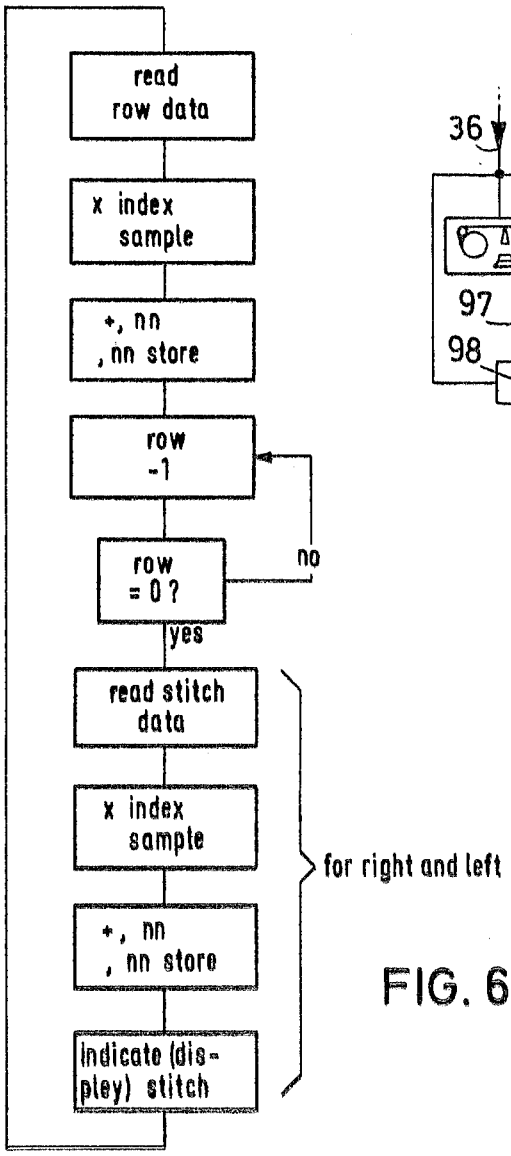
FIG. 6 shows a flow chart for the operational cycle of the computer of the knitter when operating as a knit calculator.

The index numbers fed in through the feed keyboard 29 will now be explained. Depending upon the stitch size for which the knitter is set, the type of wool used and various other knitter settings, different conditions, affecting the shape of the article to be knitted, occur for each knitted piece. In practice therefore a stitch sample is knitted using the knitter setting that will be finally employed. This sample is a piece of material, 10 cm × 10 cm for example. This is placed on a template and the stitches and rows are counted in a rectangular co-ordinate system. With the help of the measuring template it is possible to determine how many stitches and how many rows result in a particular length each time. Accordingly, it is possible to determine the index number by which it is necessary to multiply the values, contained in the knit computer programme and relating to a particular unit of the knitted piece, in order to obtain the correct shape and size when carrying out the type of knit that has been selected. A stitch index number of 1.2 and a row index number of 1.4, for example, can be fed in on the keyboard 29. Then, during the knitting operation, the computer 78 carries out the calculations illustrated in FIG. 6 in the form of a flow chart.

First, the figure which relates to the next row and which is contained in the store 69 is read. This figure is multiplied by the row index number which has previously been fed in on the keyboard 29. As a rule this does not result in a whole number, so that the places following the decimal point must be separated and stored. The places in front of the decimal point are reduced by 1 during the next knitting operation. Thereafter, a check must be made to see whether the row number has reached zero. If it has not then, during the next knitting operation, the row number is again reduced by one, and this procedure is repeated until the row number finally becomes zero. This then means that, in accordance with Table 1, a new row is reached in which the changes have to be made. The two figures for stitches are then read and multiplied by the stitch index number. Here again the places following the decimal point are suppressed and stored. The values relating to stitch changes converted in this manner are displayed, with the associated plus or minus sign, on the indicating devices 24 and 25. When the figure for the row contained in the store 69 is zero, the contents of the stores 71 and 73 are released to the indicating devices 24 and 25 respectively. At the same time, the delay element 74 is primed by way of a conductor 78'. This element responds when the next reversal of direction of movement of the cam is indicated by way of a conductor 55', and said element then brings the cam brake 75 and the buzzer 76 briefly into action. The performance of a knitting operation is communicated to the computer 78 by the output impulse of the row store 51 by way of a conductor 79. When the new stitch figures have been displayed, the next row figure is read, i.e. the next line in accordance with Table 1.

Figure 7:
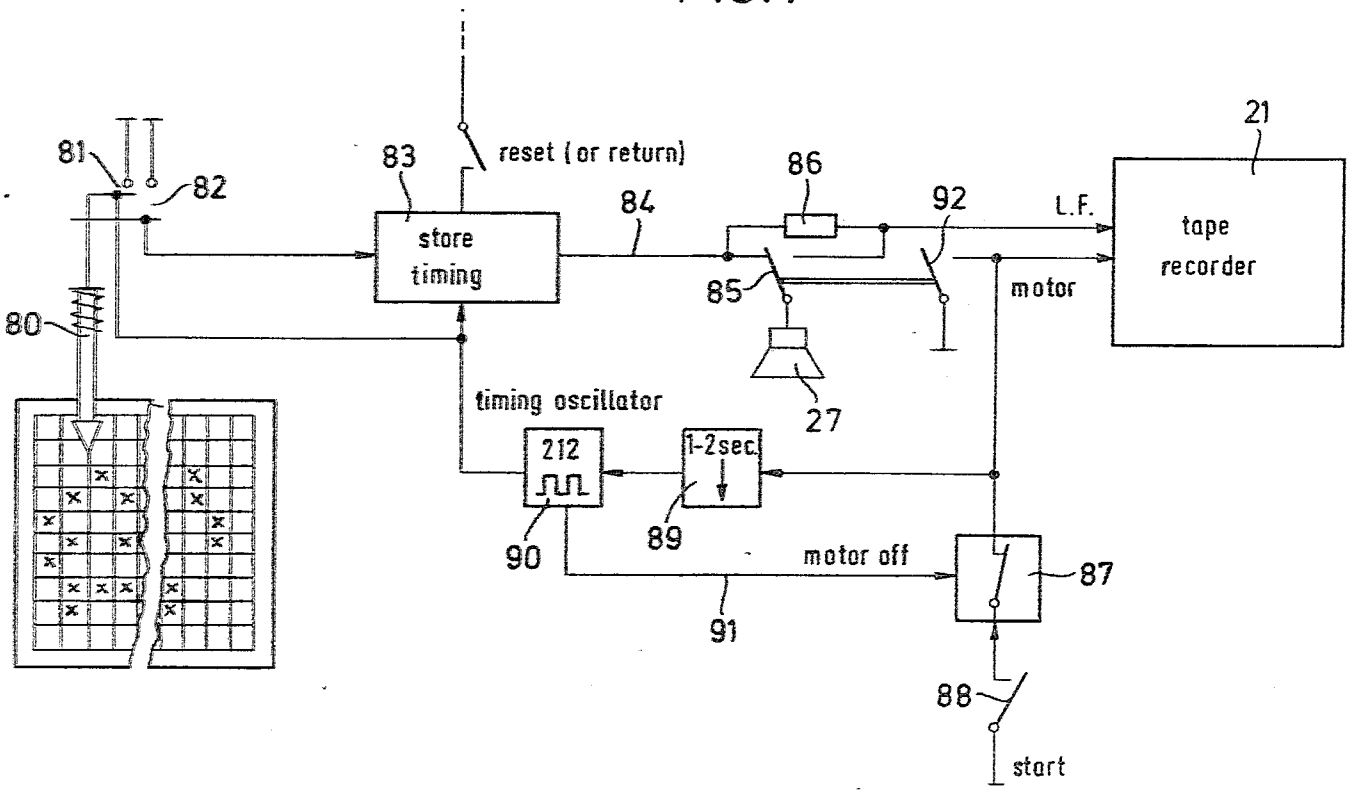
FIG. 7 illustrates diagrammatically the arrangement of a data input means for recording knitting pattern data on the magnetic tape.

To prevent the user of the knitter from using knitting patterns contained in tape cassettes that have already been played through, there is provided a device which is illustrated as a block circuit diagram in FIG. 7 and which enables the user of the knitter to make her own recording of the knitting pattern information on the magnetic tape. All that is required for this purpose is a copy of the pattern onwhich the pattern is to be knitted is represented in a visible manner. Expediently this copy of the pattern is drawn as a grid image, or it may be an image without a grid and over which a transparent square grid is placed. The user of the knitter scans the grid row by row by means of a finger key 80. The number of grid points in a row should be equal to or less than the maximum number of stitches in a row. The finger key 80 is constructed like a ball-point pen but has no writing tip. When its tip is pressed on to the underlying surface, a first contact 81 is closed, and when it is then further depressed a second contact 82 is closed. When the first contact 81 is closed, an impulse is applied to the timing-impulse input T of the store 83. This store may be, for example, a shift register having a capacity of 200 bits. The signal input of the store 83 is connected to the contact 82. Thus a logic signal is continuously fed into the corresponding store place when the contact 82 is closed, i.e. when the finger key 80 is pressed heavily on to the underlying surface.

The store 83 is so designed that a signal is generated at its output conductor 84 whenever a timing impulse is fed to the timing-impulse input T or whenever the signal input receives a signal impulse. The loudspeaker 27 of the tape recorder is connected to the conductor 84 by means of a reversing switch 85; the loudspeaker can also be used as a microphone for dictating text on to the magnetic tape. The switch 85 is bridged by a resistor 86. The resistor 86 is connected to the low-frequency input of the tape recorder.

When the switch 85 is in the position illustrated, the loudspeaker 27 is connected directly to the output conductor 84 of the store 83. Every time the finger key 80 is applied and the store content stepped forward, an impulse, which causes a clicking sound in the loudspeaker 27, occurs at the output. The person using the knitter therefore knows when she has pressed the finger key 80 sufficiently firmly to effect stepping of the store. When the contact 82 has been switched through, another sound occurs in the loudspeaker 27, so that an audible check on the operation of the finger key 80 is possible. First, the 12-bit row number 30 (FIG. 5) is produced in the store 83. The pattern information relating to a row, that ocmprises 200 bits, is then fed in, so that the store 83 has a total capacity of 212 places.

When all the knitting pattern data for a row have been fed into the store, the starting switch 88 for the tape recorder is closed for recording the row. This causes voltage to be applied to the motor input of the tape recorder by way of the closed switch 87. At the same time the time-lag circuit 89 is energized, and after a delay of 1 to 2 sec. this circuit starts up a timing oscillator 90. This generates 212 timing impusles of a given frequency, and these impulses are applied to the timing input T of the store, so that the store content is applied by way of the conductor 84 and the resistor 86 to the low-frequency input of the switched-on tape recorder. After the timing oscillator has released 212 timing impulses and the contents of the store 83 have been released, the timing oscillator 90 opens the switch 87 by way of a conductor 91, so that the motor of the tape recorder is switched off.

If, in addition to the pattern data, other information, that is later to be heard through the loudspeaker 27, is to be dictated on to the magnetic tape, the switch 85 is reversed so that the tape recorder is again switched on through a switch 92 coupled with the switch 85. The loudspeaker 27, which can also be used as a dynamic microphone, is now connected directly, through the switch 85, to the low-frequency input of the tape recorder which is switched on. In this way a text can be dictated on to the tape.

The circuit, illustrated in the form of a block diagram in FIG. 4, can be formed by using a micro-processor. Micro-processors of this kind are electronic components which are designed like a computer and can be programmed. The entire circuit, which is shown in FIG. 4 between the two dash-dot lines, can be formed for example with the help of an "Intersil IM6100" micro-processor.

Figure 8:
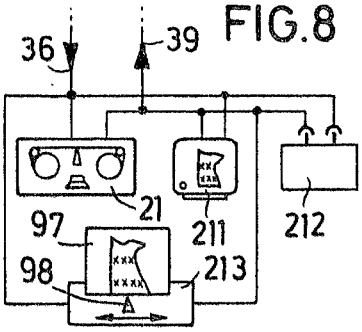
FIG. 8 shows four different possibilities of connection of devices as data source to the control unit.

FIG. 8 shows different further possiblities to connect devices to lines 36 and 39 of the circuit in FIG. 4. In addition to the tape recorder or cartridge recorder 21 explained already with reference to FIG. 4, or in place of said device, the data source used may be a data video unit 211. Such data video units are operating with a television screen and a control unit. By way of a (non-illustrated) light pencil connected to the appertaining contrl unit, the operator may record the pattern of the article to be knitted, on the television screen. The lines generated by the light pencil subsequently appear as bright lines on the screen. The corresponding data are stored in a store of the control unit. Such data video devices are known. The instrument 6800C of Franz Morat KG may be used in conjuction with a customary televison set.

It is also possible to use as a data source the electronic Read Only Memory 212 in which one or several patterns are stored. Such Read Only Memories can be obtained as integrated circuits. The operator for inst. has a collection from several Read Only Memories 212 in which the data of different knitting patterns are stored and always the Read Only Memories whose contents shall be read out via line 39 are placed into the circuit. Therefore, the connections of the Read Only Memory 212 in FIG. 8 are illustrated as plug connections to interchange the Read Only Memory. A Read Only Memory suitable to this effect is the model IM5625 of Intersil.

After all, a pattern reader 213 may be used as a data source into which a data carrier 97 is mounted which contains the pattern e.g. in a form readable optically or magnetically. The data carrier is scanned line-wise by a scanning element 98 which is moved in transverse direction relative to the data carrier 97. After each line, the data carrier 97 is advanced by one line so that scanning of the next line can be made. The pattern reader 213 is operating according to the same principle as the "Knit Radar KR 6", sold by applicants. By a corresponding control unit, the advance of the data carrier 97 and the transverse movements of the scanning element 98 may be automated, the output signals of the scanning element 98 being supplied to line 39 and the control signals for the pattern reader coming from line 36.

Devices 211, 212 and 213 are not only suitable to pick up and store the data for the pattern concerned, i.e. the limiting data for the knitting, but they may also contain the pattern data for a color pattern or stitch pattern to be made in the knitting. Therefore, the outer contours (pattern) intimated on the device 211 or the data carrier 97 additionally comprise knitting patterns. The data of the knitting patterns are supplied to the row stores 48, 49 while the shaping data get to stores 71 and 73.

What is claimed is:

1. A control unit for a hand knitter of the type having a needle bed containing a plurality of needles and on which there is mounted a movable carriage means for adjusting the position of needles individually in accordance with a proposed knitting pattern and thereby performing the knitting operation, said carriage means being displaceable transversely to the needles, characterized in that shaping data concerning the outline contour of the knitting is presented to the user, said control unit comprising:

a data source (21) for the shaping data of the knitting, said source containing knitting row numbers and stitch data concerning how many stitches are to be added to or reduced from the rows of the knitting identified by said knitting row numbers, a store (71,73) for the stitch data, a store (51) for row data, said data source (21) supplying the stitch data to said store (71,73) for the stitch data and the number for the corresponding row to said store (69) for row data, an indicating device (24,25), and a row store means (51), containing the number of a row to be knitted, for causing said stitch data to be supplied to said indicating device (24, 25) if the contents correspond to a number contained in the store for row data.

2. A control unit according to claim 1, characterized in that the data source only contains the row numbers and data of the rows in which changes in the number of stitches per row are to be made, as compared to the preceding row.

3. A control unit according to claim 1, characterized in that the store (71, 73) for the stitch data and the store (69) for row data contain at one time the data on only one row.

4. A control unit according to claim 3, characterized in that the data source (21) contains, in addition to the shaping data, the knitting pattern data for each row and that a selection circuit (43, 44, 65, 66, 67) is provided which separates the knitting pattern data from the shaping data and which supplies the knitting pattern data to one of two row stores (48,49).

5. A control unit according to claim 4, characterized in that the selection circuit contains at least one counter (44) which in response to a count indicating completion of supply of the knitting pattern data to said row stores (48,49) causes subsequent data from said data source (21) to be supplied to the row store (51) and to the store (71,73) for stitch data.

6. A control unit according to claim 1, characterized in that the store (71,73) for stitch data and the store (69) for row data contain the shaping data of several rows as supplied prior to knitting from the data source (21).

7. A control unit according to claim 1, characterized in that the data source is a magnetic tape storage device (21) to which a first monitoring circuit (61) is connected which disconnects the magnetic tape storage device upon termination of supply of all data which concerns the next row to be knitted.

8. A control unit according to claim 7, characterized in that the first monitoring circuit (61) is a level detector which disconnects the magnetic tape storage device (21) if no signal is found for a certain time on the magnetic tape, and that between the information concerning two successive rows, there is on the magnetic tape a block gap (33) the length of which is at least so great that its duration during normal running of the tape, is equal to the time required for switching off plus the response time of the first monitoring circuit (61) and the start-up time of the motor of the magnetic tape storage device (21).

9. A control unit according to claim 7, characterized in that a second monitoring circuit (60) is provided which differentiates between digital data and audio signals from the magnetic tape.

10. A control unit according to claim 1, characterized in that the row data store (69) and the stitch data store (71,73) are connected to a computer (78) connected to a numerical input device (29) for index numbers for stitches and rows.

11. A control unit according to claim 1, characterized in that a signal means (76) is provided for generating a perceptible signal, if the stitch data of the next row to be knitted differ from those of the preceding row.

12. A control unit according to claim 1, characterized in that there is provided a cam brake (75) blocking the movement of the carriage means (14) if the stitch data for the next row to be knitted differ from those of the preceding row.

13. A control unit according to claim 1 characterized in that, for the storage of a knitting pattern into said data source, a scannning key (80) having two different scanning positions is connected to an electronic store (83) which, each time the scanning key (80) is depressed, is indexed one place forward and to which, each time the scanning key is heavily depressed, information in the form of bits is additionally fed into the indexed storage positions ready to receive data.

14. A control unit according to claim 13, characterized in that a timing input of the electronic store is connectible to a pulse source (90) which, to transfer the contents of the electronic store to said data source, releases a given number of pulses each enabling the transfer of one bit of data from said electronic store to said data source, and then disconnects the data source (21).

15. A control unit according to claim 13, characterized in that a loudspeaker (27) is connected to the data source (21) and can be used also as a recording microphone.

16. A control unit according to claim 1, characterized in that the data source consists of a data video device (211) which has a store into which the shaping data may be fed by guiding a light key along a television screen.

17. A control unit according to claim 1, characterized in that the data source contains a Read Only Memory (212) in which the shaping data of the knitting are stored.

18. A control unit according to claim 1, characterized in that the data source contains a knitting pattern reader (213) which line-wise scans a data carrier on which the shape of the knitting is recorded.

19. An input device for entering a knitting pattern onto a storage medium for later use in the control unit of a hand knitter, comprising:

a scanning key having first and second scanning switch means, the first being actuated each time said key is lightly or heavily depressed, the second being actuated only when said key is heavily depressed, an electronic storage device having a plurality of storage locations, said locations being addressed sequentially in response to successive actuations of said first switch means, a bit of data being entered in the currently addressed storage location each time said second switch means is actuated when said key is heavily depressed, whereby, as said scanning key is sequentially depressed onto a replica of the pattern to be stored, the corresponding pattern will be entered into said electronic storage device.

20. An input device according to claim 19 wherein said knitting pattern is stored on said storage medium in blocks of data each corresponding to one row of said pattern, and wherein said electronic storage device has a plurality of storage locations equal in number to the maximum number of stitches per row, said input device further comprising:

timing means, cooperating with said electronic storage device and operable after a row of pattern data has been entered into said electronic storage device using said key, for reading out the entire contents of said electronic storage device and for entering said read-out contents into said storage medium.

21. An input device according to claim 20 wherein said storage medium is a magnetic tape recorder, and wherein said timing means reads out said row of pattern data at the rate requisite for correct data entry onto a magnetic tape, and further comprising means, operatively connected to said timing means, for turning off said magnetic tape recorder when said row of pattern data has been read out and entered onto said magnetic tape.

22. An input device according to claim 21 characterized in that a loudspeaker is connected to the magnetic tape store and can be used also as a recording microphone.

23. In a hand knitter of the type wherein row-by-row knitting is accomplished in accordance with knitting pattern information supplied from a data source, the improvment wherein said data source also supplies shaping data related to the outline contour of the article to be knitted, said shaping data consisting of row number identifying the rows of knitting in which changes must be made in the number of stitches per row, and stitch data specifying the requisite change, comprising:

stitch change determining means for ascertaining whether the row next to be knitted corresponds to a row identified by the row numbers pf said shaping data as being one in which a stitch change is required, and display means, cooperating with said determining means, for displaying the supplied stitch data indicating the requisite stitch change for that next row.

* * * * *